United States Patent [19]

George et al.

[11] 3,963,548

[45] June 15, 1976

[54] APPARATUS AND METHOD OF FORMING HEMMED CURTAINS AND THE LIKE

[75] Inventors: Alexander George, Charlotte; Howard Snelson, Hickory; James White, Mooresville; Jacob D. Lentz, Jr., Troutman, all of N.C.

[73] Assignee: Miracle Seam, Inc., Charlotte, N.C.

[22] Filed: May 28, 1974

[21] Appl. No.: 473,426

[52] U.S. Cl. ..... 156/88; 156/227; 156/256; 156/443; 156/459; 270/61 R

[51] Int. Cl.[2] ..... B31F 1/00

[58] Field of Search ..... 156/92, 93, 204, 443, 156/88, 459, 227, 256; 112/2, 121.11, 121.12, 147, 42 C, 130; 161/101, 104; 223/1; 270/21, 61 R, 83, 78, 93

[56] References Cited

UNITED STATES PATENTS

| | | | |
|---|---|---|---|
| 2,533,873 | 12/1950 | Brandvein | 112/426 |
| 2,546,831 | 3/1951 | Newell | 112/121.11 |
| 2,737,999 | 3/1956 | Schjeldahl | 270/61 R X |
| 2,740,457 | 4/1956 | Wood et al. | 161/104 |
| 2,964,312 | 12/1960 | Schmidt | 270/61 R |
| 3,101,602 | 8/1963 | Tosi | 161/101 X |
| 3,652,080 | 3/1972 | Jenkins | 270/61 R |
| 3,755,033 | 8/1973 | Emus | 156/88 |

*Primary Examiner*—William A. Powell
*Assistant Examiner*—David A. Simmons
*Attorney, Agent, or Firm*—Richards, Shefte & Pinckney

[57] ABSTRACT

Apparatus and method for forming hemmed curtains including advancing a continuous length of fabric while simultaneously carrying adhesive filaments across the fabric, then stopping the fabric and performing a series of operations thereon at an operating station, including cutting the fabric along a transverse line adjacent the adhesive filaments, then folding the fabric end pieces with a double folded hem extending over the adhesive filaments and with the cut edge of the fabric contained within the fold so as not to be exposed, then heating the adhesive filaments to melt them and thereby secure the folded hems in place, and finally advancing the fabric again to present another part thereof for similar processing. Preferably, two adhesive filaments are carried across one of the fabric pieces whereby the folded hem thereof will be secured in place along spaced parallel securing lines so as to provide a curtain rod pocket in such hem.

24 Claims, 26 Drawing Figures

APPARATUS AND METHOD OF FORMING HEMMED CURTAINS AND THE LIKE

BACKGROUND OF THE INVENTION

Curtains are normally sold commercially in matching pairs, each curtain in a pair being referred to as a curtain panel, and these curtain panels include top and bottom hems providing a pleasing appearance. At the present time, such curtain panels are formed predominately by a semi-automatic, assembly line method in which a continuous length of fabric is processed through a series of sequential operations until a completed curtain panel is produced.

More particularly, a continuous length of fabric having the side edges thereof properly seamed is first cut into desired lengths by an operator, after which the cut length is transported to a second operator who manually feeds the cut length through a sewing machine which folds one cut edge of the cut length and stitches the fold to form one of the top or bottom hems, and the cut length is normally transported to another sewing machine operator who stitches the other hem of the curtain panel. Additionally, it is usually desirable to form the top hem of the curtain panel with a tubular pocket for receiving a curtain rod when the curtain panel is hung, and since the curtain rod pocket is typically only about 1¼ inches in width whereas the top seam has a typical width of at least 2½ inches, it may be necessary to further process the curtain panel by further stitching of the top hem to form a smaller curtain rod pocket therein.

It is believed apparent that the aforesaid semiautomated procedure for forming curtain panels is time consuming because of the several distinct steps which must be sequentially performed to finish a curtain panel, and labor costs are relatively high because each of these steps requires an operator having at least some experience and skills.

Some effort has been made heretofore to automate curtain forming operations as suggested, for example, by U.S. Pat. No. 2,740,457, issued to Wood on Apr. 3, 1956, and U.S. Pat. No. 2,546,831, issued to Newell on Mar. 27, 1951. In the Wood patent, however, the cut ends of the fabric are formed with a simple overlapping fold whereby the cut edge of the hems are left exposed so as to detract from the appearance of the finished curtain panel and present the possibility of noticeable unraveling of the exposed cut edge. An exposed cut edge may be permissible in forming goods such as diapers, for which the Wood machine was particularly designed, where appearance is of secondary consideration, but in curtains, where appearance is of primary importance, exposed cut edges could well render curtains unsalable. Moreover, in the Wood patent, liquid adhesive is used to secure the overlapping hems in place, and the presence of liquid adhesive in an automated fabric forming operation presents a problem with respect to the liquid adhesive inadvertently reaching other operating elements or being deposited on the advancing fabric to mar the appearance of the finished curtain panel.

In the aforesaid Newell patent, a machine is provided for hemming the edges of rectangular fabric pieces to form bedsheets, tablecloths, towels and the like, and this machine must, of necessity, be quite large because it includes four separate areas at which a particular operation is performed. Thus, the fabric is cut at a first station and then moved to a second station at which it is measured and spread, then moved again to a third station where hems are folded, and finally moved to a fourth station where the folded hems are secured. It will therefore be apparent that the Newell machine is relatively large and complex, and, more importantly, a significant amount of time is required to physically move the fabric from station to station and to perform separately the four distinct operations required to produce a finished bed sheet. Finally, it would be almost impossible to use the Newell machine with very sheer material which is often used for curtains (e. g. Ninon or Marquesette fabrics) because such sheer material would very likely become bunched or otherwise distorted during movement thereof from station to station.

By substantial contrast, the present invention provides a fully automatic and relatively simple arrangement by which a continuous length of fabric is cut, and hems are folded and secured in place almost simultaneously at one operating station whereby finished curtains are continuously formed at a very high production rate.

SUMMARY OF THE INVENTION

In accordance with the present invention, a curtain making machine is provided which includes apparatus for advancing a continuous length of fabric along a generally horizontal path of movement and then stopping the fabric after it has advanced a predetermined distance so that a portion thereof is located at an operating station. While the fabric is being advanced, at least two adhesive filaments are carried transversely thereacross, and after the fabric advance has been stopped, it is cut along a line transverse to the path of movement thereof so that the adhesive filaments as laid on the end portions of the two cut fabric pieces. These end portions are then folded by mechanical folding elements to form a double folded hem which overlaps the adhesive filaments and has the cut edges of the fabric pieces within the overlapping hem portion so as not to be exposed, and the adhesive filaments are then melted to secure the folded hems in place along transverse securing lines.

Preferably, one filament is laid across the end portions of one of the fabric pieces to secure in place what will be the bottom hem of the finished curtain, and two filaments are laid across the end portion of the other fabric piece in spaced parallel relation to secure in place what will be the top hem of the finished curtain, the two securing lines acting to provide the top hem with a tubular curtain rod pocket.

The continuous length of fabric is fed across a generally horizontal extending surface having an opening formed therein, and all of the equipment needed to carry out the abovedescribed operation is located within, above or adjacent this opening whereby all of these operations can be carried out sequentially at one operating station. A cutting block is located within the opening and a transversely extending cutter blade is arranged for vertical reciprocating movement to cut the fabric part at the cutting block. Two pairs of fabric engaging clamps are also located in the opening on each side of the block, one of these clamps on each side being fixed and having a part of the cut fabric piece tucked therein by first tucking elements located above the horizontal surface and movable to tuck the fabric in the fixed clamp. The other of these clamps is movable and has a part of the cut fabric piece tucked therein by a second tucking element located above the horizontal surface. Each movable clamp is then arranged to rotate over its associated fixed clamp to thereby form a double folded hem in which the end portion of the cut fabric is folded between a first adjacent fabric portion and a next adjacent fabric portion which are in overlapping relation as a result of the rotational movement of the movable clamp.

To advance the fabric, two tracks extend along the machine parallel to the side edges of the fabric and spaced outwardly therefrom so as not to interfere with any of the operations performed on the fabric at the aforementioned operating station, and at least one, but preferably three, carriage members are mounted in the tracks and operated by drive means to move selectively to a position for engaging the folded hem of a fabric piece and pulling the fabric piece along the horizontal surface. Each carriage member is provided with normally closed fabric engaging elements which are automatically opened to receive the folded hem therebetween, then closed to hold the hem as the fabric piece is being pulled, and finally to open again to release the fabric piece after it has been formed into a finished curtain panel and moved away from the operating station.

DESCRIPTION OF THE PREFERRED EMBODIMENTS

Figure 1:
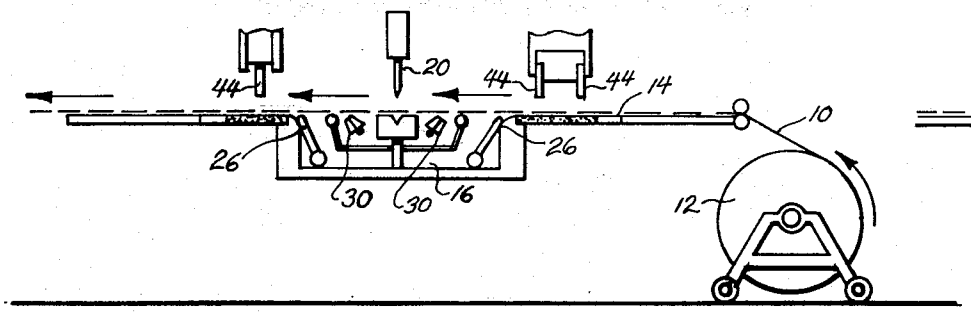
FIGS. 1–8 illustrate diagrammatically the steps of forming a finished hemmed curtain in accordance with the present invention.
Figure 2:
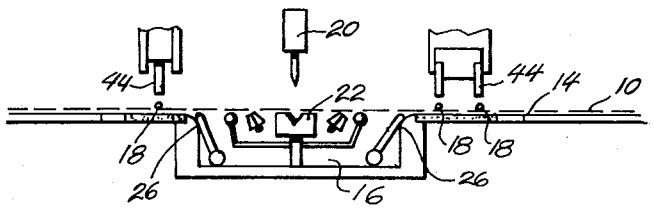
Figure 3:
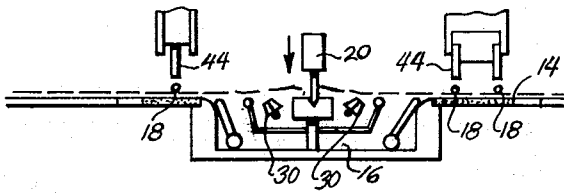
Figure 4:
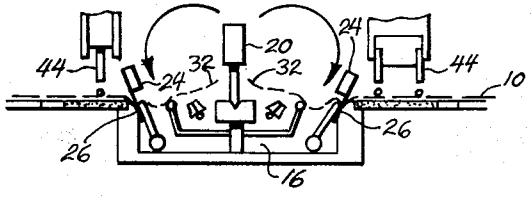
Figure 5:
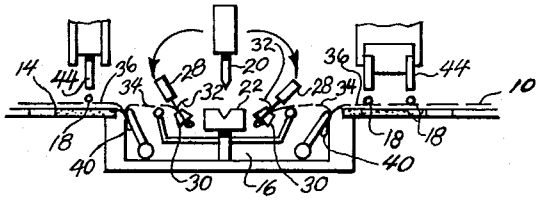
Figure 6:
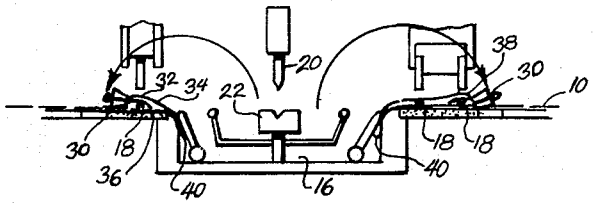
Figures 18, 23:
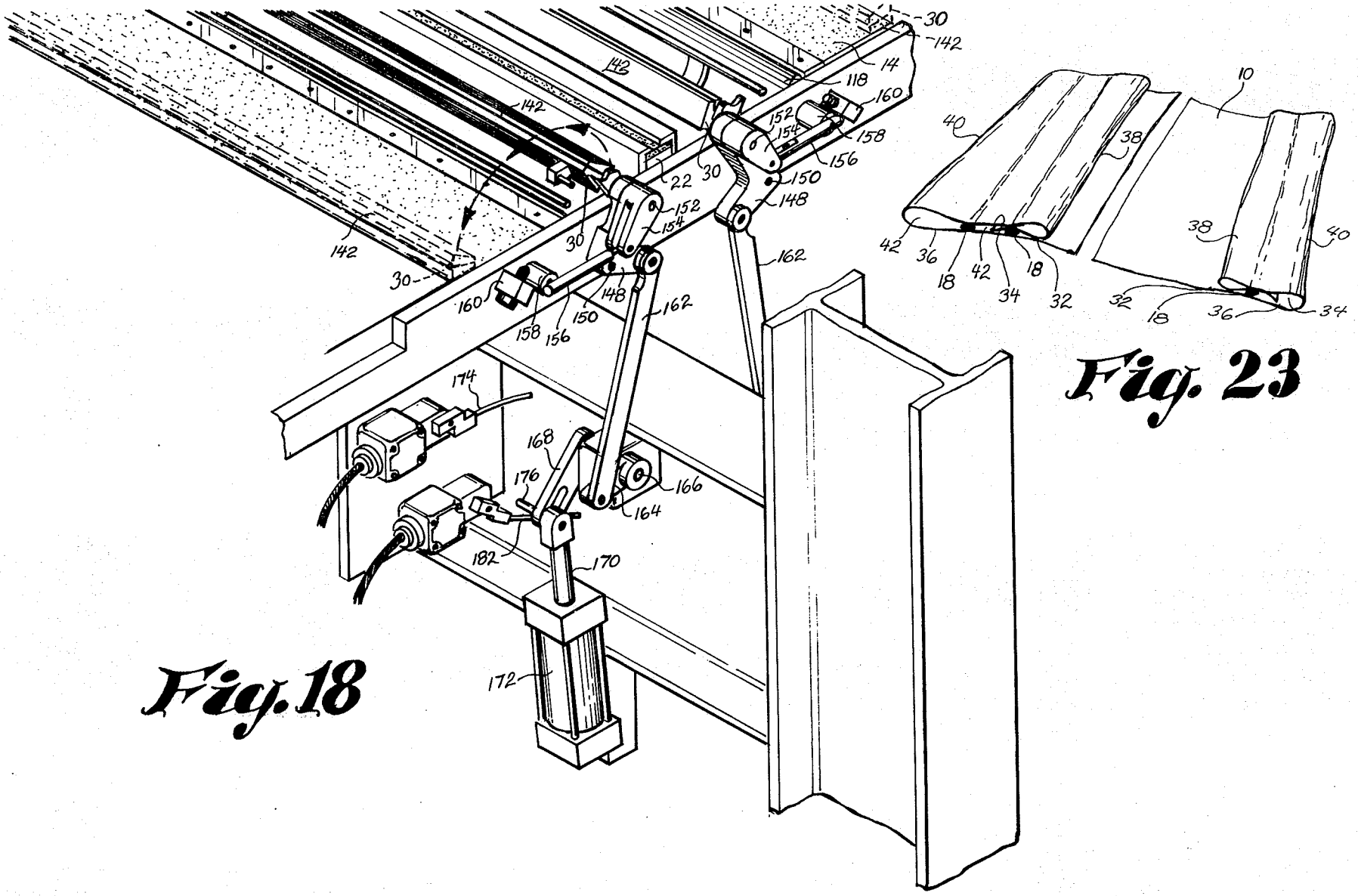
FIG. 18 is a perspective view of a portion of the operating station of the present invention illustrating the fixed and movable folding jaws.
FIG. 23 is a perspective view of a finished curtain formed in accordance with the present invention.
Figure 20:
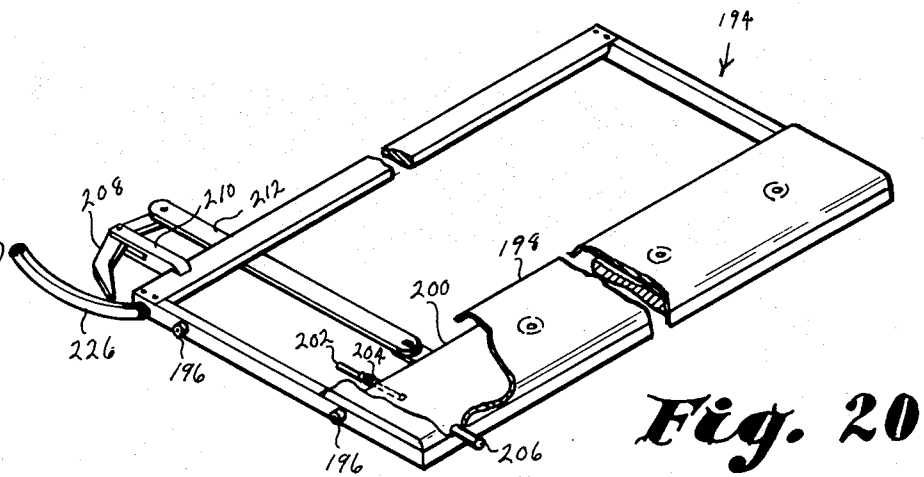
FIG. 20 is a perspective view of the fabric carrying carriage member.

Looking now in greater detail at the accompanying drawings, FIGS. 1–8 illustrate diagramatically the sequence of operations in forming a finished curtain in accordance with the present invention. FIG. 1 illustrates the continuous length of fabric 10 being fed from a roll 12 and across a generally horizontal work surface 14 which includes an opening 16 formed therein, the fabric 10 being carried from right to left in FIG. 1 as indicated by the direction arrows. As will be described in greater detail presently, three adhesive filaments 18 are carried across the fabric 10 simultaneously with its advance and laid thereon along transverse lines as illustrated in FIG. 2. After the fabric 10 has been advanced a predetermined distance, it is automatically stopped and a vertically reciprocating cutter element 20 moves downwardly between filaments 18 and against cutting block 22 located in the opening 16 to cut the fabric 10 into two pieces along a line transverse to the path of movement thereof as shown in FIG. 3. First tucking elements 24, located above the horizontal surface 14, are then lowered to tuck a part of each of the two cut fabric pieces into fixed clamps 26 located in the opening 16, all as shown in FIG. 4, and second tucking elements 28 likewise tuck another part of each of two fabric pieces into movable jaws 30 as shown in FIG. 5. The movable jaws 30 are then rotated about the fixed clamp 26 from a position in the opening 16 to a position on the other side of fixed jaws 26 on the horizontal surface 14 as shown in FIG. 6. It will be noted, as best seen in FIGS. 6 and 23, that this folding of the fabric pieces by movable jaws 30 causes the end portion 32 of each fabric piece to be folded between a first adjacent fabric portion 34 and an overlapped next adjacent fabric portion 36 whereby the cut edge end portion 32 is contained within the fold. The tucks in movable tucking jaws 30 form a first transverse fold line 38 in the hem of one fabric piece, and the tuck in the fixed tucking clamp 26 forms a second transverse fold line 40 in the hem of the other fabric piece (See FIG. 22) whereby a pleasing hem appearance is provided, and appearance is also enhanced by the fact that the end portion 32 is folded between the first and next adjacent fabric portion 36, 38 so as not to be exposed and so as to cover any unslightly unraveling at the cut edge of the end portion 32. It will also be noted in FIGS. 6 and 23 that the folding action of the movable jaws 30 results in two of the adhesive filaments 18 being disposed between an end portion 32 and a next adjacent portion 36 of each fabric piece, respectively, and the third adhesive filament 18 is spaced from one of the aforesaid adhesive filaments 18 and located between the next adjacent fabric portion 36 and the overlapping first adjacent fabric portion 34 of one of the fabric pieces whereby, when melted, the third adhesive filament 18 will result in a tubular, transversely extending curtain rod pocket 42 being formed in the top curtain hem as seen in FIG. 23.

After the two fabric pieces have been folded as described above, three electrodes 44 having a transverse extent directly above the adhesive filaments 18 are lowered to clamp the folded fabric pieces therebetween along the lines defined by the adhesive filaments 18, and these electrodes 44 are part of a conventional radio frequency generator (not shown) which is energized to melt the adhesive filaments 18 to form a liquid adhesive which secures the folds in place as shown in FIG. 23. After the folds are secured in place, the electrodes 44 are raised, the movable jaws 30 are returned to their initial position in opening 16, and both of the fabric pieces are advanced to the left in a manner to be described in greater detail below.

It is to be recognized that after the fabric 10 is cut (FIGS. 2 and 3), hems are simultaneously formed in each of the cut pieces of fabric 10, the hem formed in the right hand fabric piece being the top hem of a curtain panel and the hem formed in the left hand fabric piece being the bottom hem of another curtain panel. The other end of the left hand fabric piece has previously had a top hem formed therein during the immediately preceding operation of the machine so that the left hand fabric piece becomes a finished curtain panel, and the right hand fabric piece having a top hem formed therein is advanced so it becomes the left hand fabric piece during the next operation of the machine whereupon it will likewise become a finished curtain panel as shown in FIG. 23.

Figure 9:
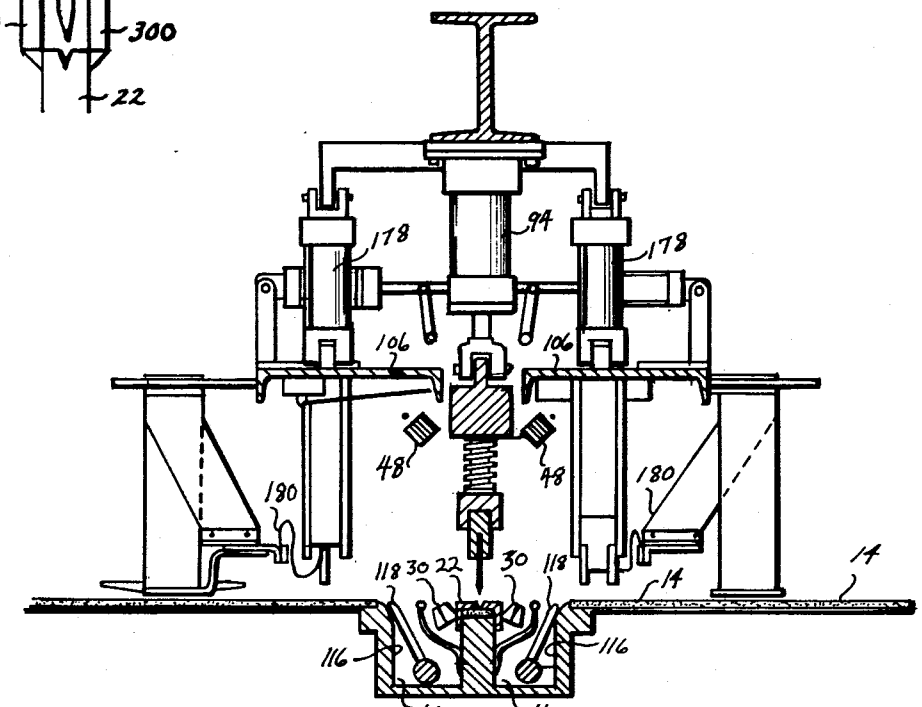
FIG. 9 is a side elevational view taken through the center of the operating station of the curtain making machine of the present invention.

FIGS. 9–13 illustrate in greater detail the apparatus for laying the adhesive filaments 18 across the fabric 10. As has been previously noted, adhesive filaments 18 are laid on the fabric 10 at both sides of the cutter element 20, and the present invention accordingly employs two filament carrying arrangements, each operating in an identical fashion but on opposite sides of the cutter element 20. Thus, two bar-type tracks 48 are disposed on each side of the cutter element 20, respectively, as shown in FIG. 9, and each of these tracks 48 has a slidable member 50 mounted thereon by a plurality of roller elements 51 so as to be movable along the tracks 48. The slidable members 50 are connected to a cable 52 (FIG. 10) which acts to pull the slidable member 50 along the tracks 48. The cable 52 is arranged as a closed loop (FIG. 12) with the two slidable members 50 attached thereto for movement in opposite direction transversely across the fabric 10 when the cable 52 is operated by a motor 54. Thus when the closed loop cable 52 is pulled in one direction by the motor 54, one slidable member 50 on one side of cutter element 20 is pulled across the fabric 10 from the left to right while the other slidable member 50 on the other side of cutter element 20 is simultaneously pulled across the fabric 10 from right to left.

Figure 10:
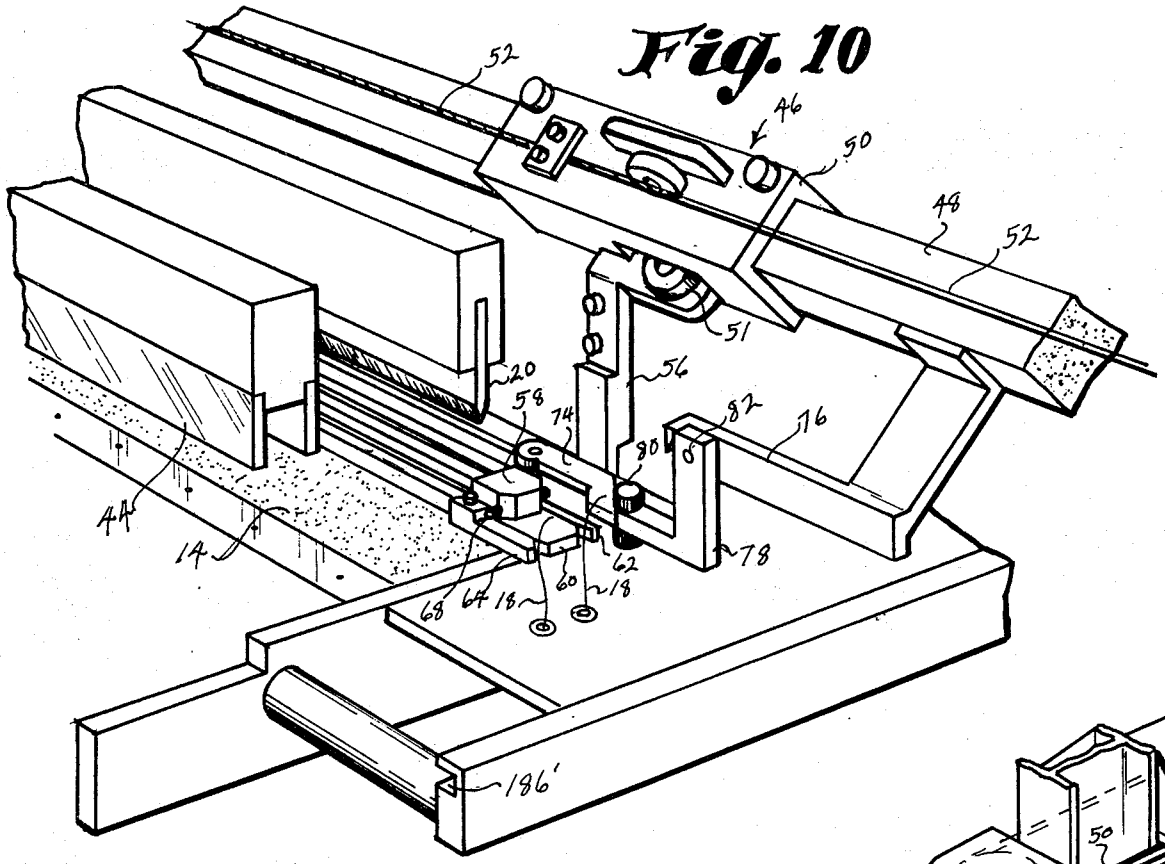
FIG. 10 is a perspective view illustrating a portion of the adhesive filament carrier arrangement.
Figure 13:
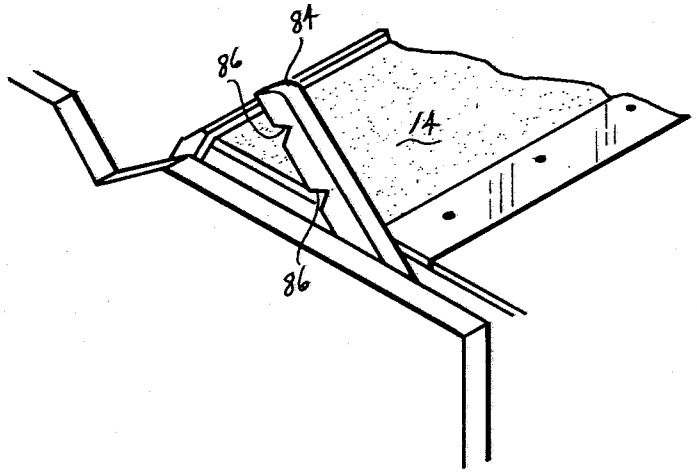
FIG. 13 is a detail view showing the clamping member for holding the adhesive filaments in place.

As best seen in FIG. 10, each slidable member 50 has a depending support 56 on which is mounted a filament carrier 58 that includes a stationary center piece 60 and two arm pieces 62, 64 attached thereto by pivot rods 66, the arm pieces 62, 64 being biased by springs 68 to positions abutting the center piece 60. The arm piece 62 is formed with an identation 70 receiving a projection 72 formed on the other arm 64 whereby pivotal movement of the arm piece 62 will cause corresponding pivotal movement of the arm piece 64, and the arm piece 62 is also fixed to a cam element 74 which projects forwardly beyond the carrier 58. A fixed support 76 depends from the track 48, and an L-shaped element 78 having a roller 80 fixed thereto is pivotally mounted on support 76 at 82, the L-shaped element 78 being capable of limited pivotal movement in a clockwise direction from its position shown in FIG. 10 and being incapable of pivotal movement in a counterclockwise direction from its FIG. 10 position. Two adhesive filaments 18 extend upwardly through openings 82 from a filament supply (not shown) so as to present two vertically extending filaments ends adjacent to and beneath the L-shaped element 78. At the other side of the machine, a clamping element 84 having notches 86 formed therein is mounted for pivotal movement between a raised position as shown in FIG. 13 and a lowered position when it is generally flush with horizontal surface 14 of the machine. Preferably, this clamping element 84 is operated by a solenoid (not shown) to move between its raised and lowered positions. When fabric is being used which has a very smooth or slick surface, there may be a tendency for the adhesive filaments 18 to move along the fabric from the position thereon at which they were laid, and it may therefore be preferable to add a clamping element or similar filament holding arrangement at both sides of the fabric to hold the adhesive filaments in place.

The operation of the filament carrying apparatus is as follows. In response to the fabric 10 being advanced as will be explained presently, the motor 54 is energized to pull the cable 52 in a first direction which causes the filament carrier 58 at the front of cutter element 20 to move transversely across the advancing fabric 10 from left to right, and the other filament carrier 58 at the back of cutter element 20 to move likewise, but from right to left. When the filament carriers 58 approach the end of such movement, the cam arm 74 thereof contacts the roller 80 (FIG. 11) which causes the cam arm 74 and both of the arm pieces 62, 64 to pivot outwardly from the center piece 60. The arm pieces 62, 64 will remain in this outwardly pivoted position as the filament carrier 58 continues its movement whereby the two vertically extending ends of filament 18 will be positioned between arm pieces 62, 64 and the center piece 60, respectively. Still further movement of the filament carrier 58 will result in the cam arm 74 passing over the roller 80 and returning to its initial position with arm pieces 62, 64 abutting the center piece 60 with the ends of filaments 18 held securely therebetween. At this point, the slidable members 50 strike a limit switch 88 which reverses the direction of cable motor 54 and also causes the clamping element 84, at the other side of the machine, to be moved to its raised position as shown in FIG. 13. Reversal of cable motor 54 causes the movement of the filament carriers 58 to be reversed, but the initial return movement of the filament carriers 58 does not result in a reopening of arm pieces 62, 64 because when the cam arm 74 strikes the roller 80, the L-shaped pivot arm 78 pivots upwardly about pivot 82 to permit the filament carrier 58 to pass therebeneath. The filament carriers 58 then move back across the fabric 10, carrying the filaments 18, until they move past the raised clamping elements 84 and strike another limit switch 90 which causes the clamping elements 84 to be pivoted to their lowered positions. As the clamping elements 84 move to their lowered positions the notches 84 engage the filaments 18, pull them from the filament carriers 58, and press the filaments 18 against the fabric 10 so that they are held at positions extending transversely across the fabric 10 and in spaced parallel relation to one another. The filament carriers 58 continue their movement for a short distance until a third limit switch 92 is contacted which stops the cable motor 54 so as to stop the filament carriers 58.

When the forward movement of the fabric is automatically stopped after it has been advanced a predetermined distance as will be explained in more detail in connection with the fabric advancing apparatus, a hydraulic motor 94 (see FIG. 9) becomes operative to lower the cutter element 20 until it bears against the cutter block 22 to serve the fabric 10 along a transverse line intermediate the filaments laid down by the filament carriers 58 as described above. The hydraulic motor 94 includes a pressure responsive switch (not shown) which responds to a rise in pressure resulting from the cutter elements 20 pressing against the cutter block 22, and this switch starts the fabric tucking and folding operations shown in FIGS. 14–18.

Figure 14:
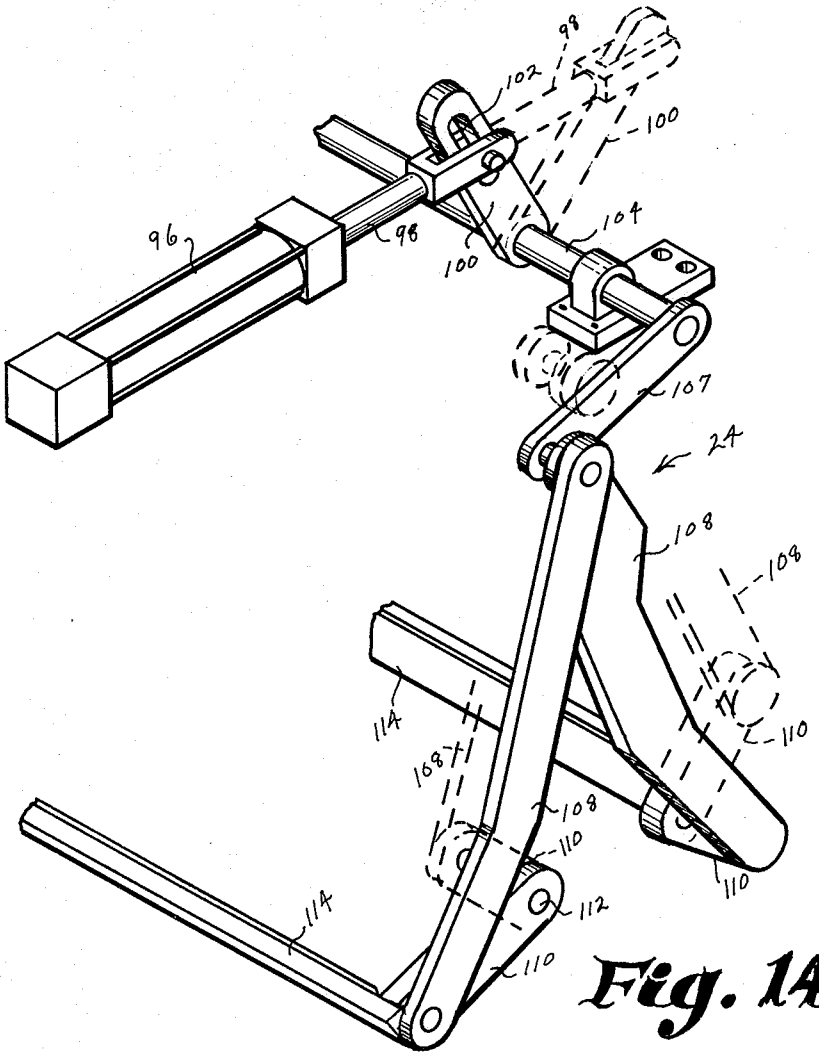
FIG. 14 is a perspective view of the first tucking apparatus of the present invention.
Figure 15:
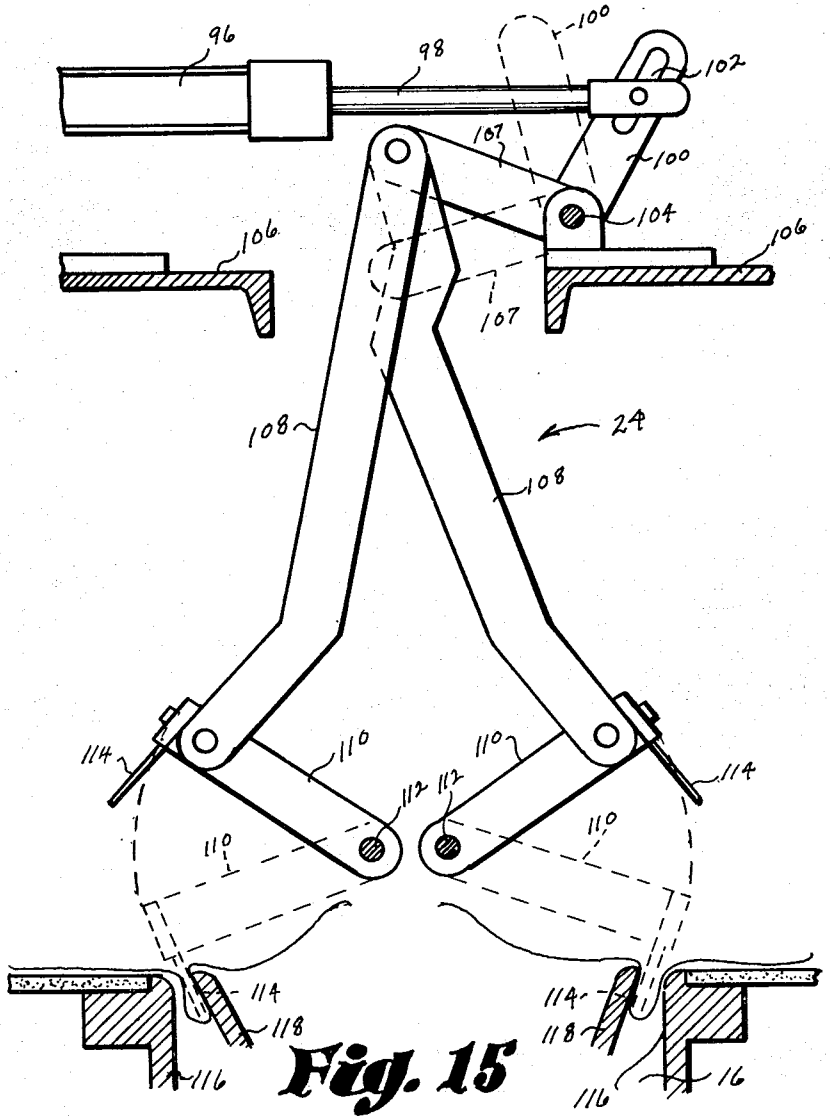
FIG. 15 is a side elevational view of the first tucking apparatus shown in FIG. 14.

As best seen in FIGS. 14 and 15, the first tucking apparatus is operated by a hydraulic motor 96 which is controlled by a solenoid operated valve (not shown) energized by the aforementioned pressure operated switch, and this motor 96 includes an operating rod 98 connected to one end of a link 100 by a lost motion pin-and-slot connection 102. The link 100 is connected to a pivot rod 104 which is mounted on the superstructure 106 of the machine above the horizontal surface 14, and the pivot rod 104 has fixed thereto an operating link 107 which is pivotally connected to a pair of linkage elements 108 which, in turn, are connected to operating elements 110, respectively, mounted on fixed pivot rods 112. The extending ends of the operating elements 110 each have a tucking plate 114 attached thereto, the tucking plate 114 extending transversely across and above the fabric 10. Located in the opening 16 are a pair of fixed tucking clamps, each comprised of a fixed wall 116 and a pivoted clamping element 118 which may be solenoid operated to pivot between an open position spaced from fixed wall 116 to receive fabric 10 therebetween and a closed position engaging the received fabric 10 and holding it against the fixed wall 116.

It will be apparent that when the motor 96 is operated to move the rod 98 to the left in FIGS. 14 and 15, links 100 and 107 will be moved in a counterclockwise direction to cause the linkage elements 108 to pivot the operating elements from the positions thereof shown in full lines to the position shown in dotted lines in FIG. 15 whereby the tucking plates 114 will tuck the fabric 10 between the fixed wall 116 and the clamping element 118, the clamping element 118 then being pivoted to its closed position to hold the tucked fabric 10 in place and form a transversely extending fold therein.

Figure 16:
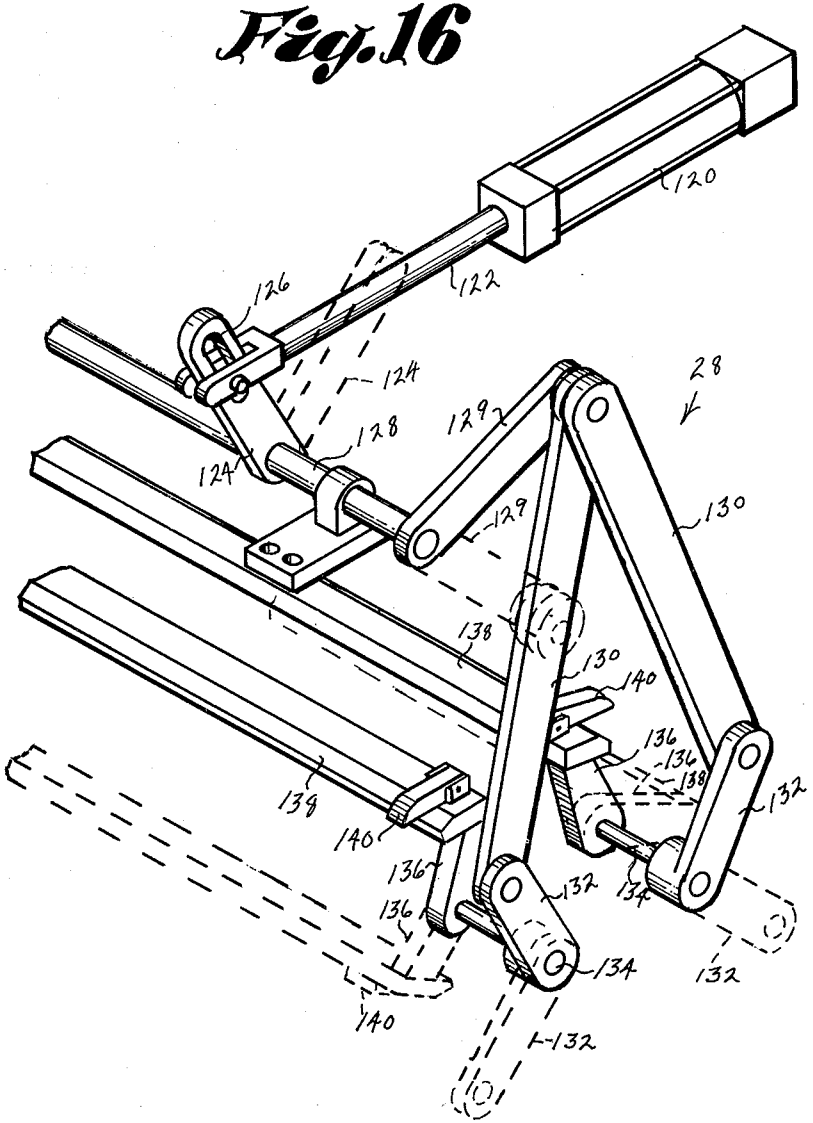
FIG. 16 is a perspective view of the second tucking apparatus of the present invention.
Figure 17:
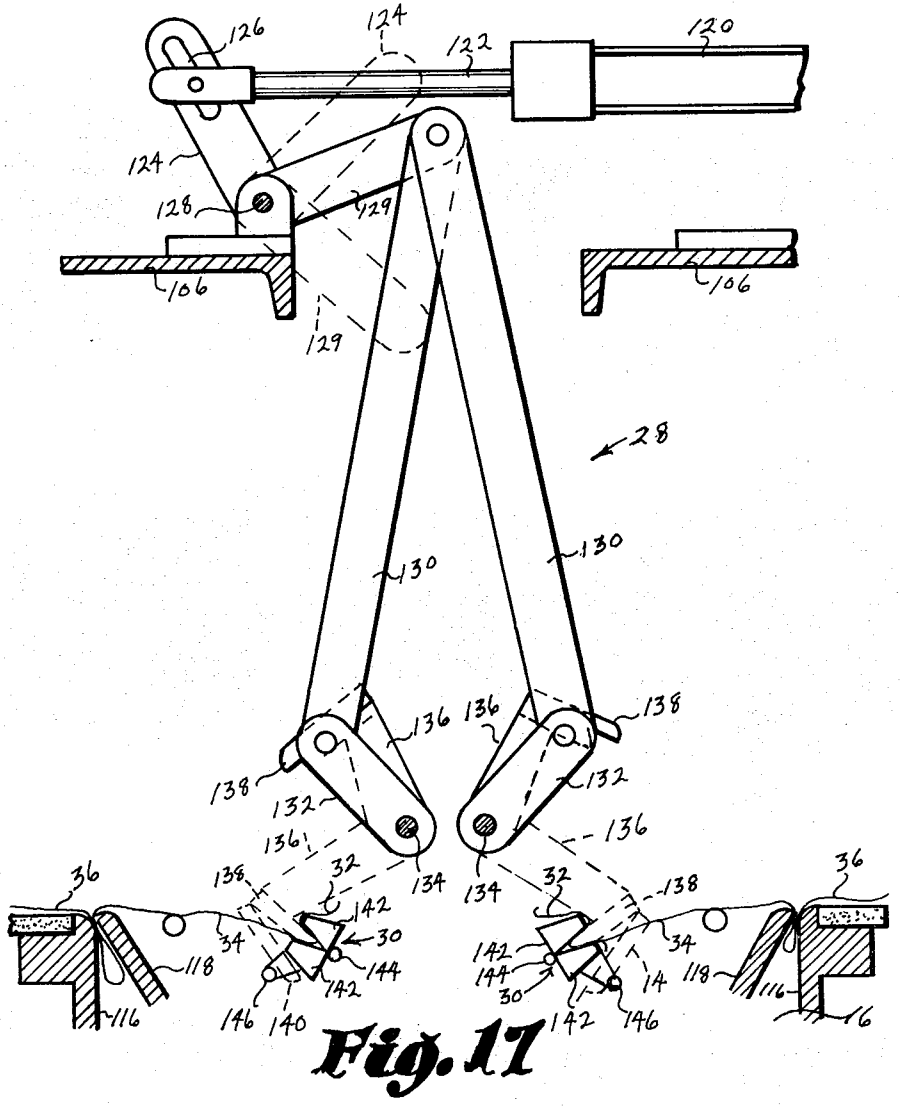
FIG. 17 is a side elevational view of the second tucking apparatus shown in FIG. 16.

The second tucking apparatus is illustrated in FIGS. 16 and 17, and it includes a hydraulic motor 120 connected by an operating rod 122 to a link 124 through a lost motion pin-and-slot connector 126, the link 124 being arranged for pivotal movement with a pivot rod 128 mounted on the superstructure 106 of the machine, above the horizontal surface 14. An operating link 129 is fixed to the pivot rod 128 and pivotally joined to a pair of first connecting links 130 which are pivotally connected, respectively, to second connecting links 132 that are each fixed to one end of a shaft 134, the other end of which is fixed to an operating member 136 which supports a tucking plate 138 extending transversely across the fabric 10. The tucking plate 138 has pivotally mounted thereon a wedge 140, the location of the wedge 140 being such that it will be beyond the side edge of the fabric 10 and will not engage the fabric 10 when the tucking plate 138 is lowered to its tucking position. Located in the opening 16 are a pair of movable jaws, each including two jaw members 142 connected together by a hinge 144 which normally biases the jaw members 142 toward each other in a closed position. One of the jaw members 142 has secured thereto a projecting pin 146 which is located beyond the side edge of the fabric 10 to be engaged by the wedge 140 when the tucking plate 138 is moved to its lowered position.

When the motor 120 is operated, the rod 122 moves to the right in FIGS. 16 and 17 to pivot the link 124 in a clockwise direction until it assumes its dotted line position, whereupon the operating members 136 and linking plates 138 will be rotated from the full line positions to the dotted line positions as shown in FIGS. 16 and 17. As the tucking plates 138 approach the jaw members 142, the wedges 140 will engage the pins 146 and cause the jaw members 142 to pivot outwardly to an open position for receiving the fabric 10 which is tucked therein by tucking plates 138 to thereby form folds in the fabric 10 which extends transversely of the fabric 10 in spaced parallel relation to the folds formed between fixed wall 116 and the clamping elements 118 as described above. It will also be noted that the end portion 32 of each cut piece of fabric 10 is a tail extending from the jaw members 142, the first adjacent portion 34 of each fabric piece extends between the jaw members 142 and the clamping elements 118, and the next adjacent portion 36 of each fabric piece is disposed on the horizontal surface 14.

The apparatus for folding the fabric pieces is best illustrated in FIG. 18, and it includes a crank 148 mounted on a fixed pivot shaft 150, one arm of the crank 148 having a shaft 152 passing therethrough to a first connection with a pair of the jaw members 142 and a second connector with a turning link 154. The turning link 154 has a rod 156 projecting therefrom with a roller 158 mounted at the extending end thereof to abut a fixed stop 160. The other arm of the crank 148 is connected to a link 162 which in turn, is connected to another link 164 that is fixed to a shaft 166 rotated by a drive link 164 that is fixed to a shaft 166 rotated by a drive link 168 connected to the operating rod 170 of a hydraulic motor.

When the motor 172 is operated, the rod 170 thereof moves upwardly to rotate drive link 168, shaft 166 and link 164, which causes the crank 148 to rotate about its fixed pivot 150 in a direction to carry the shaft 152 and the movable jaw members 142 over and about the clamping element 118 until the jaw members 142 reach the horizontal surface 14 at a position on the other side of the clamping element 118 as shown by the dotted lines in FIG. 18. As the jaw members 142 are being carried in this manner by the crank 148, the roller 158 bears against the fixed stop 160 to cause the turning link 54 to rotate with respect to the crank 148 and thereby rotate shaft 152 whereby the jaw members 142 will be rotated approximately 180°. As a result, the aforementioned first adjacent portion 34 of the fabric piece is carried about the fold held by the clamping element 118 from one side thereof to the other when it overlaps the next adjacent portion 36 of the fabric piece, and the end portion 32 of the fabric piece is disposed between the overlapping first and next adjacent portions 34, 36. Also, it is to be noted that since the three adhesive filaments 18 had previously been laid across the next adjacent fabric portions 36 as described above, the overlapping first adjacent fabric portions 34 and the end portions 32 will be disposed on top of the adhesive filaments 18 as shown in FIG. 6.

It will also be noted in FIG. 18 that an upper trip switch 174 is operated by a pin 176 projecting from the rod 170 when it reaches its uppermost position at which the jaw members are at their dotted line position, and this switch 174, when tripped, causes fluid to be admitted to hydraulic motors 178 (FIG. 9) which act to lower electrodes 44 against the folded fabric 10, the electrodes 44 being disposed transversely of the fabric 10 at positions to clamp the adhesive filaments, located within the fabric folds, against the horizontal surface 14. The electrodes 44 are connected through conductors 180 to a radio frequency generator (not shown) which is then energized by a pressure switch responsive to the pressure in the hydraulic motors 178 to generate radio frequency waves through the electrodes 44, these waves causing the adhesive filaments 18 to be heated until they melt into liquid adhesive which acts to secure the folded fabric in place along the transverse securing lines determined by the location of the adhesive filaments 18 prior to their being melted. The adhesive filaments 18 are conventional dielectric monofilament adhesive threads, and they are readily melted by a radio frequency generator producing an output of 7.5 kilowatts at the double element electrode 44 and an output of 4 kilowatts at single element electrode 44.

The radio frequency generator remains in an operating state for a predetermined period of time, after which the hydraulic motors 178 automatically raise the electrodes 44 to their initial raised position where a trip switch (not shown) is engaged to cause motor 172 (FIG. 18) to lower its operating rod 170 to return the movable jaw members 142 to their initial full line position in the opening 16. When the operating rod 170 reaches its lowermost position, the pin 176 engages a lower trip switch 182 which commences the fabric advancing apparatus.

When the movable jaw members 142 are returned to their initial full line position, the fabric 10 which has been held by the jaw members 142 simply slides out the jaw members 142 because the fabric 10 is being held in place while the jaw members 142 are moving to return to their initial position. More specifically, the fabric piece to the left of the cutter element 20 is held at its left end by a fabric advancing carriage member 194 and at its right end by clamping element 118, and the bond formed by the melted filament 18 holds the fold in place, whereby fabrics held by the jaw member 142 will simply slide therefrom as the jaw member 142 begins its return movement. The fabric piece to the right of the cutter element 20 is similarly held by a clamping element 118 and a hold-down bar 183 located at the front of the machine and solenoid operated (not shown) to press against the fabric 10 and hold it in place whenever the fabric 10 is not being advanced.

Figure 19:
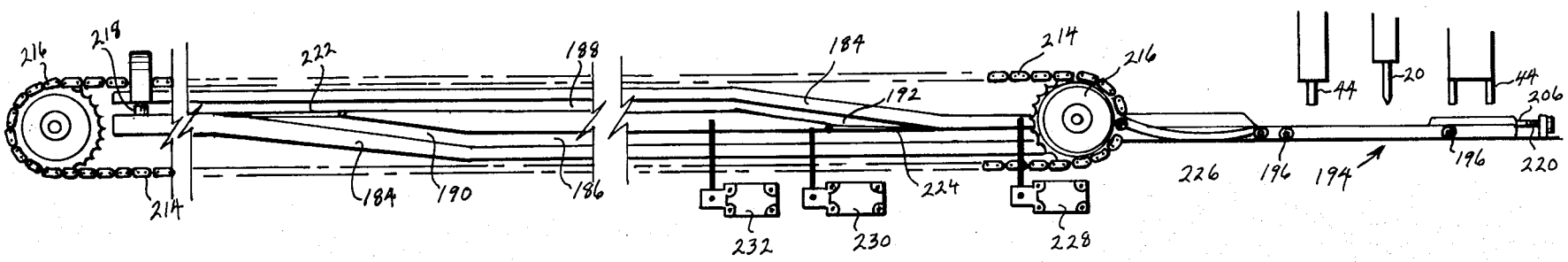
FIG. 19 is a side elevational view illustrating the fabric carrying apparatus of the present invention.
Figure 24:
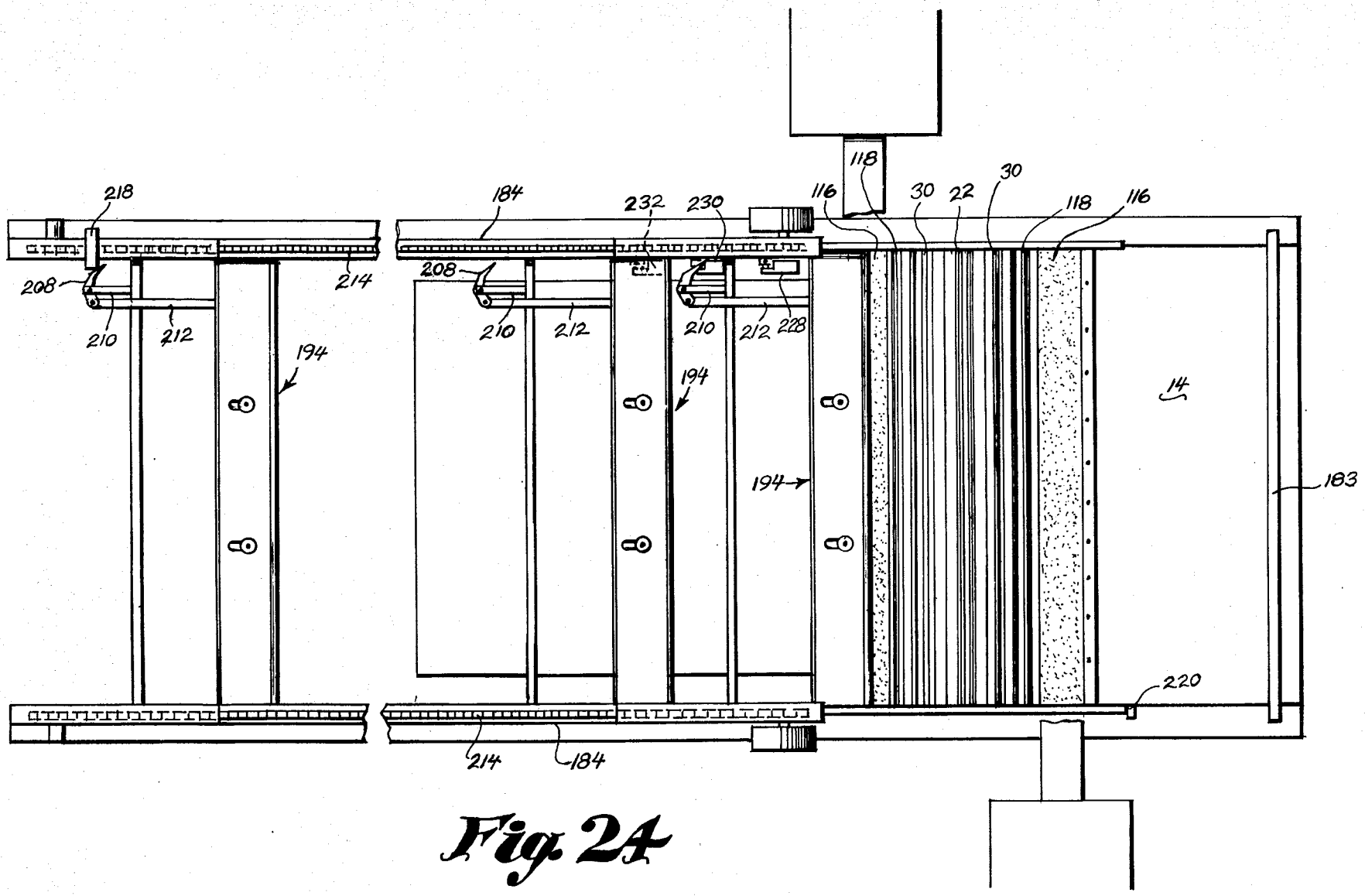
FIG. 24 is a plan view of the horizontal work surface.

The fabric advancing apparatus is illustrated in FIGS. 19–22, and includes a pair of identical track members 184 extending in parallel relation along the sides of the machine beyond the side edges of the fabric 10, one of the tracks 184 being shown in FIG. 19. The track 184 includes a lower horizontally extending slot 186, an upper horizontally extending slot 188, a first inclined slot 190 connecting the horizontal slots 186, 188 and having a pivoted plate 222 at the upper end thereof, and a second inclined slot 192 connecting the horizontal slots 186, 188 and having a pivoted plate 224 at the lower end thereof. The right hand end of the lower horizontal slot 186 terminates immediately adjacent a slot 186 formed in a fixed guide member 194 located on each side of the opening 16 in the horizontal surface 14 as shown in FIG. 10, the slot 186′ serving as a continuation of the lower horizontal slot 186.

Figure 22:
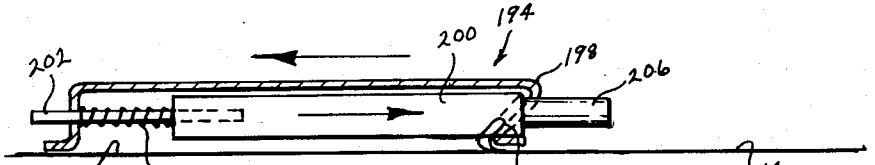
FIG. 22 is a detail view similar to that of FIG. 21 and illustrating the carriage member carrying the fabric piece.

A carriage member 194 is carried by the tracks 184 by a pair of rollers 196 mounted on each side of the carriage member 194 and disposed within the slots of the tracks 184. The carriage member 194 is generally rectangular in shape and includes a relatively fixed fabric engaging member 198 extending transversely across the fabric 10 when the carriage member 194 is mounted in the tracks 184 as aforesaid, and a relatively movable fabric engaging member 200 is disposed adjacent the fixed member 198 for movement into and out of engagement therewith. A spring rod 202 is secured to the movable member 200 and extends through an opening in the fixed member 198 in slidable relation thereto, and a coil spring 204 is disposed about the rod 202 to bear against the fixed member 198 and the movable member 200 to urge the forward surface of the movable member 200 into contact with a corresponding surface of the fixed members 198 as shown in FIG. 22. The movable member 200 also includes a pin 206 projecting in slidable relation through the forward surface of the fixed member 198 to extend forwardly therebeyond. A cam arm 208 is pivotally mounted at the rear of the fixed member 198 in a bracket 210, and one end of the cam arm 208 is connected to the movable member 200 through a linkage 212.

The carriage member 194 is moved along the tracks 184 by an endless chain 214 mounted about two sprockets 216 to extend in adjacent parallel relation to the tracks 184, and a connecting arm 216 is fixed to the chain 214 and the carriage member 194 in pivotal relation thereto whereby movement of the chain 214 about the sprockets 216 will push or pull the carriage member 194 along the tracks 184. At the rear end of the tracks 184 a fixed stop 218 is disposed for striking the cam arm 208 when the carriage member 194 reaches the rear end of the upper horizontal track slot 186, and another fixed stop 220 is mounted on the horizontal surface 14 near the front of the machine for striking the projecting pin 206 as the carriage member 194 approaches the forwardmost end of its travel in the slot 186′.

Preferably, a plurality of carriage members 194 are carried by the tracks 184 and connected to the chain 214 at equal spacings therealong whereby the carriage members 194 will sequentially move to a position for engaging a fabric piece and advancing it. Thus, in a typical machine wherein curtains having a standard length of 81 inches are to be formed, the chain 214 will have a total length of 36 feet, and three carriage members 194 mounted in the tracks 184 and connected to the chain 214 at three locations thereon spaced twelve feet apart.

Figure 21:
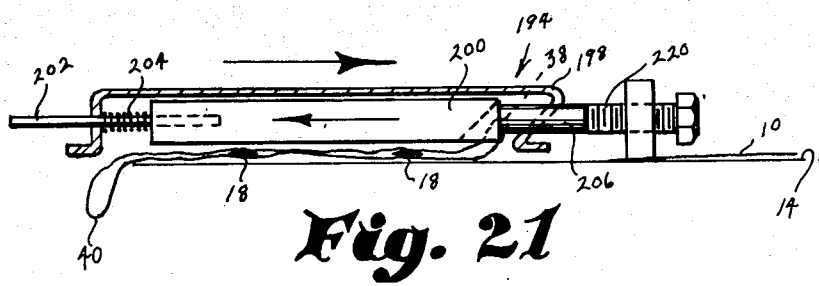
FIG. 21 is a detail view showing the carriage member as it engages the hem of a fabric piece.

When, as described above, the fabric advancing apparatus is commenced by virtue of pin 176 striking the lower limit switch 182 (FIG. 18), the motor driving one of the sprockets 216 is energized and the chain 214 begins moving in a clockwise direction as seen in FIG. 19. If three carriage members 194 are being utilized, one of them will be in the upper track slot 188 near the forward inclined slot 190, and it will be connected to the upper reach of chain 214 by its connecting arm 226. As the chain 214 begins its clockwise travel, the carriage member 194 will be moved to and then down the inclined track 192, and then past the pivoted plate 224 which pivots downwardly to permit the carriage member 194 to then the right along lower horizontal slot 186 and its continuation slot 186'. At about the time the connection between the chain 214 and the connecting arm 226 reaches the right hand limit of the right hand sprocket 216 (FIG. 19), the projecting pin of 206 of the carriage member 194 will contact the fixed stop 220, as seen in FIG. 21 and the movable member 200 of the carriage member 194 will be moved rearwardly with respect to the fixed member 198 to provide a spacing therebetween. This spacing is located directly above the folded hem just formed in the right hand piece of fabric 10, and because this folded hem has a natural tendency to project upwardly from the surface of the fabric 10, it will move into the spacing between the fixed member 198 and the movable member 200. Continued movement of the chain 214 will cause the carriage member to begin moving to the left, and as the projecting pin 206 moves out of contact with fixed stop 220, the movable element 200 will be urged by spring 204 into contact with fixed member 198 to engage the hem of fabric 10 therebetween as illustrated in FIG. 22.

As the carriage member 194 continues to move toward the left, it pulls the fabric 10 along the horizontal surface 14, causing the fabric supply 12 to feed fabric 10, and the carriage member 194 passes under the closed pivoted plate 222 and then trips a first switch 228 which energizes the drive for the apparatus laying out the adhesive filaments 18 described above whereby such apparatus operates simultaneously with the advance of the fabric 10. When the fabric is being advanced by a carriage member 194, the solenoid operated clamps 118 are moved to position away from fixed wall 116 to release the fabric during the advance thereof. The carriage member 194 continues to move to the left until it trips a second switch 230 which acts to slow down the motor driving one of the sprockets 216, an then trips a third switch 232 which stops the motor and stops further movement of the carriage member 194, the slow down provided by second switch 232 preventing an abrupt stopping of the fabric advance which could cause undesirable bunching up or folding of the fabric 10. Since the location of trip switch 232 stops the fabric and thereby determines the length of the fabric extending from the cutter element 20, it will be apparent that the location of the trip switch 232 determines the length of the curtain panels being formed accordingly. It is perferable to provide for placing the trip switch 232 at various locations if variable curtain panel lengths are anticipated.

The carriage member 194 will remain at its stopped position adjacent the third switch 232 until the next cycle of the machine is completed, and when the chain 214 is again caused to move, the carriage member 194 will again move to the left along lower horizontal slot 186, then up the inclined slot 190 and through the pivoted plate 224, which pivots upwardly, temporarily, and then along the upper horizontal slot 188 until the carriage member cam arm 208 strikes the rear stop 218. The cam arm 208 is thereby caused to pivot in the bracket 210, and pull the linkage 212 to move the movable member 200 away from the fixed member 198 against the urging of spring 204 whereby the hem of the fabric will be released and the fabric piece, which now has its top and bottom hems formed to provide a completed curtain panel, will fall between the tracks 184 for collection in a stack of horizontally spread-out curtain panels. The carriage member 194 will stop at or near the rear stop 218 by virtue of the immediately following carriage member 194 tripping the third switch 232. When another cycle of the machine is completed, the chain 214 will begin moving again, and the carriage member 194 at the rear stop 218 will begin moving to the right along upper horizontal slot 188, across the closed pivot plate 224 until it reaches its aforesaid initial position near the inclined slot 192 where it stops. Thus, there are three carriage members 194, and each one operates through a complete cycle in three stages.

Figure 7:
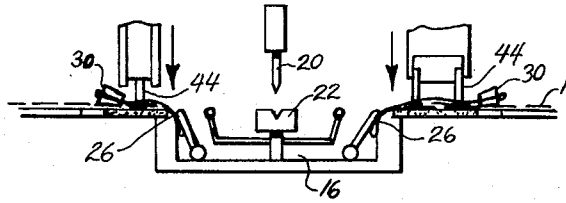
Figure 8:
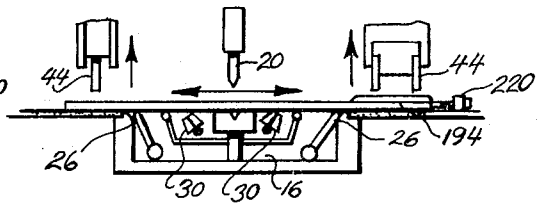
Figure 11:
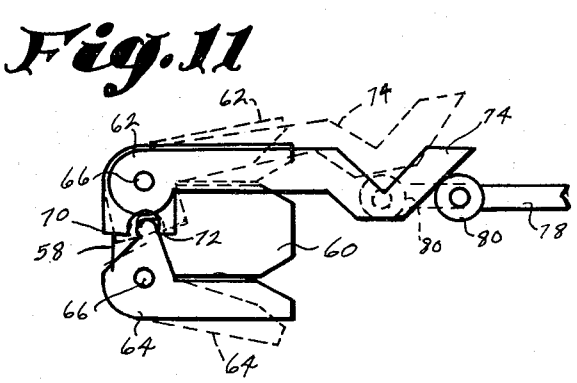
FIG. 11 is a detail view illustrating the operation of the adhesive filament receiving jaws of the carrier arrangement shown in FIG. 9.
Figure 12:
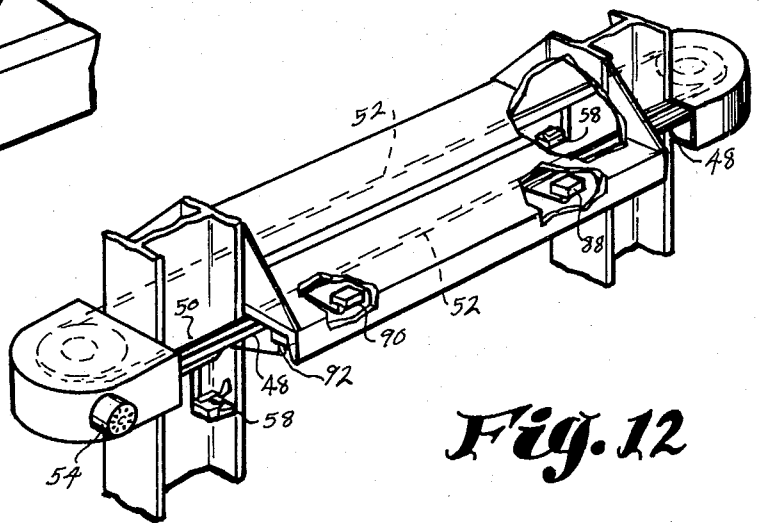
FIG. 12 is a perspective view, partly broken away, illustrating the entire filament carrier arrangement.

The operation of the curtain making machine of the present invention may be briefly summarized as follows, beginning with the fabric 10 being advanced across the horizontal surface 14 as shown in FIG. 1. When the fabric advancing carriage member 194 strikes the trip switch 228, the filament carrier 46 is activated to cause adhesive filaments 18 to be simultaneously carried transversely across the fabric 10 and then held thereagainst after the advance of fabric 10 has been stopped by carriage member 194 hitting limit switch 232. Limit switch 232 also causes the cutter element hydraulic motor 94 to become energized to lower the cutter element 20 against the cutter block 22 and sever the fabric 10 into two pieces along a transverse line. When the pressure in the hydraulic motor 94 reaches a predetermined level, a pressure switch energizes the solenoid operated motors 96 and 120 to activate the tucking plates 114 and the tucking plates 138 to thereby tuck each cut fabric piece into transversely extending folds at clamping element 118 and jaws 142, respectively. After the tucking plates 114 and 138, and the cutter element 20 have been raised to their initial positions, the motor 172 is operated to rotate the jaw members 142 about the clamps 118, whereby each fabric piece is folded with the end portions thereof folded between the overlapping first and next adjacent fabric portions with one of the fabric pieces having a single filament disposed between the end portion and the next adjacent fabric portion and with the other fabric piece having two adhesive filaments located, respectively, between the end portion and the next adjacent fabric portion and between the first and next adjacent fabric portions as shown in FIGS. 6 and 23. This folding motion of the jaws 142 also causes the trip switch 174 (FIG. 18) to be contacted by pin 176 to thereby energize the hydraulic motors 178 which lower the electrodes 44 to positons clamping and adhesive filaments 18 as shown in FIG. 7, and the electrodes 44 are energized to melt the adhesive filaments 18, whereupon the electrodes 44 are raised. Then, the appropriate carriage member 194 moves to a position over the folded hem of the right hand fabric piece to engage the folded hem and advance the fabric to the left, thereby commencing another cycle of the machine.

Figure 26:
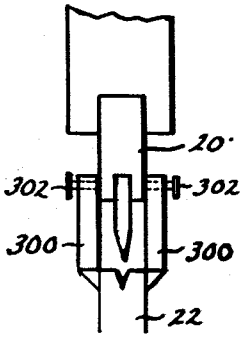
FIG. 26 is a detail view showing the cutter element shown in FIG. 25 at its lower position.
Figure 25:
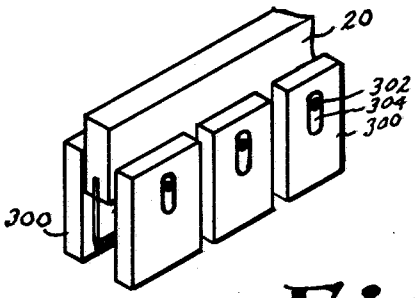
FIG. 25 is a detail view showing in perspective a modified form of the cutter element of the present invention.

As mentioned above, the present invention has particular application in connection with the forming of curtain panels from very sheer material because of the facility with which the machine of the present invention is able to advance and process such sheer material without distortion, and a modified form of the cutter element of the present invention, which is particularly adapted for use with very sheer material, is illustrated in FIGS. 25 and 26. The cutter element 20 and the cutter block 22 are identical to those of the previously described embodiment and a plurality of weights 300 are mounted along both sides of the cutter element 20 by a pin element 302 extending through a slot 304 in each block 300. When the cutter element 20 is lowered against the cutter block 22 to sever the fabric, the weights 300, which normally hang from the cutter element 20 to a point adjacent the lower end of the blade thereof, will come into contact with shoulders 306 to hold each end of the cut fabric in place thereat after the fabric is severed. Since the weights 300 have a freedom of vertical movement provided by the slots 304, they will simply rest on the cut ends of the fabric and prevent those ends from springing away from the cutter element 20 until it is raised. When very sheer fabric is being used, it may be desirable to have the cutter element 20 remain at its lowered position until all tucking of the fabric has been completed, thereby assuring that the sheer fabric will be reasonably taut for proper tucking. In any event, the weights 300 will prevent distortion of the sheer fabric as a result of the natural tendency of such fabrics to spring away from the cutter blade after the fabric is severed.

The present invention has been described in detail above for purposes of illustration only and is not intended to be limited by this description or otherwise to exculde any variation or equivalent arrangement that would be apparent from, or reasonably suggested by, the foregoing disclosure to the skill of the art.

We claim:

1. Apparatus for forming hemmed curtains and the like from a continuous length of fabric, said apparatus including:

a. means for selectively advancing said continuous length of fabric along a generally horizontal path of movement and stopping said advance after said fabric has moved a predetermined distance to present said fabric at an operating station for processing;

b. means located at said operating station for cutting said fabric into two pieces along a line transverse to said path of movement thereof;

c. means located at said operating station for folding the end portion of each of said cut fabric pieces along a first transverse fold line to overlap a first adjacent portion of said fabric piece and for folding said first adjacent portion along a second transverse fold line to overlap a next adjacent portion of said fabric piece with said end portion disposed between said first and next adjacent portions so as not to expose the cut edge of said end portion, said folding means being arranged to first tuck said fabric along said second transverse fold line after said fabric has been cut and to tuck said fabric along said first transverse fold line at a location between said first tuck and the cut end of said fabric piece, and d. means located at said operating station for securing said fabric piece to its next adjacent fabric portion along a transverse line located near the cut edge of said end portion and located between said first and second transverse fold lines to thereby form a permanent double-fold in each said fabric piece.

2. Apparatus for forming hemmed curtains and the like as defined in claim 1 and further characterized in that said securing means additionally secures said first adjacent fabric portion of at least one of said fabric pieces to the next adjacent portion thereof along a transverse line intermediate said first and second fold lines, said intermediate transverse securing line being spaced from said second transverse fold line sufficiently to form a rod pocket between said intermediate transverse securing line and said second transverse fold line.

3. Apparatus for forming hemmed curtains and the like as defined in claim 1 and further characterized in that said folding means includes first clamping means for each said fabric piece arranged for selective operation between an open fabric receiving disposition and a closed fabric engaging disposition, and includes first tucking means for each said fabric piece arranged to tuck a part of said fabric piece in said first clamping means at said open disposition thereof to fold said fabric piece along said second transverse fold line thereof, said first clamping means being operable at said closed disposition thereof to engage and hold said folded fabric piece along said second transverse fold line.

4. Apparatus for forming hemmed curtains and the like as defined in claim 3 and further characterized in that said folding means includes second clamping means for each fabric piece arranged for selective operation between an open fabric receiving disposition and a closed fabric engaging disposition, and includes second tucking means for each fabric piece arranged to tuck a part of said fabric piece in said second clamping means at said open disposition thereof to fold said fabric piece along said first transverse fold line thereof, said second clamping means being operable at said closed disposition thereof to engage and hold said folded fabric piece along said first transverse fold line.

5. Apparatus for forming hemmed curtains and the like as defined in claim 4 and further characterized in that said first clamping means has a fixed position, and in that said second clamping is selectively movable between an initial position on one side of said first clamping means to a second position on the other side of said first clamping means, the movement of said second clamping means to said second position thereof acting to move said end portion and said first adjacent portion of said fabric piece about said transverse fold line thereof to a position at which said first adjacent portion of said fabric piece overlaps said next adjacent portion with said end portion disposed between said first and next adjacent portions.

6. Apparatus for forming hemmed curtains and the like as defined in claim 5 and further characterized in that said second clamping means includes a pair of jaw members biased toward one another and in that said second tucking means includes a wedge member contacting one of said jaw members to move it away from the other said jaw member against said bias to receive said part of said fabric piece tucked by said second tucking means.

7. Apparatus for forming hemmed curtains and the like as defined in claim 1 and further characterized in that said fabric advancing means includes at least one carriage member for selectively engaging one of said fabric pieces at one of said transverse fold lines thereof and pulling said fabric pieces along said horizontal path of movement.

8. Apparatus for forming hemmed curtains and the like as defined in claim 7 and further characterized in that said carriage member includes a pair of elements normally biased toward one another and relatively movable to a position spaced from another, in that said carriage means is connected to drive means which imparts a reciprocating motion to said carriage member along said horizontal path of movement of said fabric, in that first opening means is provided at one end of the path of reciprocating movement of said carriage member to make contact therewith and cause separation of said relatively movable elements adjacent said one fold line of said fabric piece whereby said relatively movable elements will receive said fabric piece therebetween and will engage said fabric piece when said carriage member moves out of contact with said first stop means, and in that second stop means is provided at the other end of the path of said reciprocating movement of said carriage member to make contact therewith and cause separation of said relatively movable elements whereby said fabric piece engaged between said relatively movable elements will be released.

9. Apparatus for forming hemmed curtains and the like as defined in claim 17 and further characterized in that said carriage member is mounted for movement in tracks extending along said horizontal path of movement of said fabric and spaced outwardly from the side edges of said fabric.

10. Apparatus for forming hemmed curtains and the like as defined in claim 8 and further characterized in that a trip switch is provided in the path of movement of said carriage means and connected to said carriage means drive means to stop movement of said carriage member when it contacts said trip switch, the position of said trip switch in said carriage member path of movement being adjustable for selectively determining the position of said carriage member when it is stopped.

11. Apparatus for forming hemmed curtains and the like as defined in claim 9 and further characterized in that a plurality of carriage members are mounted in said tracks in spaced relation to one another and arranged to alternately move to a position for engaging and advancing said fabric pieces.

12. Apparatus for forming hemmed curtains and the like from a continuous length of fabric, said apparatus including:

a. horizontal surface means across which said fabric is moved, said horizontal surface means including an opening extending transversely of the path of movement of said fabric;

b. means for advancing said fabric along said horizontal surface means and across said opening therein;

c. means for cutting said fabric into two pieces along a line transverse to said path of movement thereof, said cutting means including a block located in said opening and a cutter element located above said horizontal surface means and movable into and out of contact with said block to cut said fabric;

d. means for folding said cut fabric pieces including pairs of spaced, transversely extending clamping means located in said opening on each side of said cutter, respectively, tucking means located above said horizontal surface means for selectively tucking said fabric pieces into said clamping means for engagement thereby, and means for moving one of said clamping means in each said pair with respect to the other to form an overlapping fold at the cut end portion of each of said fabric pieces; and e. means for securing said folded end portions of said fabric pieces including means for carrying adhesive filaments transversely across said fabric to positions at which they will be covered by said overlapping folds, and means located adjacent said opening for melting said adhesive filaments to secure said overlapping folds in place.

13. Apparatus for forming hemmed curtains and the like as defined in claim 12 and further characterized in that said fabric advancing means includes a pair of parallel extending tracks located, respectively, outwardly of the side edges of said fabric, and at least one carriage member mounted in said tracks for reciprocating movement along said horizontal surface means, said carriage member including means for selectively engaging one of said fabric pieces at an overlapping fold thereof to advance said fabric piece during said movement of said carriage member and for selectively releasing said fabric piece after it has been advanced a predetermined distance.

14. Apparatus for forming hemmed curtains and the like as defined in claim 12 and further characterized in that said adhesive filament carrying means operates simultaneously with said fabric advancing means.

15. Apparatus for forming hemmed curtains and the like as defined in claim 12 and further characterized in that each of said movable clamping menas engages one of said fabric pieces, respectively, adjacent the cut end portion thereof to form a transversely extending fold between an end portion and the first adjacent portion of said fabric piece, and in that said movable clamping means is rotated about said other clamping means from one side thereof to the other to overlap said first adjacent fabric portion over a next adjacent fabric portion with said fabric piece end portion disposed between said first and next adjacent fabric portions.

16. Apparatus for forming hemmed curtains and the like as defined in claim 12 and further characterized in that said filament carrying means carries one adhesive filament transversely across one of said cut fabric pieces whereby said overlapping fold therein will be secured in place along one transverse securing line, and two adhesive filaments transversely across the other of said cut fabric pieces in spaced parallel relation whereby said overlapping fold therein will be secured in place along two transverse securing lines to form a curtain rod pocket in said overlapping fold of said other cut fabric piece.

17. Apparatus for forming hemmed curtains and the like as defined in claim 12 and further characterized in that said cutter element has weight means mounted along each side thereof for vertical movement with respect to said cutter element, said weight means being arranged to rest against said cutter block when said cutter element moves into contact therewith to hold the cut edges of the severed fabric in place thereat.

18. Apparatus for forming hemmed curtains and the like from a continuous length of fabric, said apparatus including:

a. means for selectively advancing said continuous length of fabric along a generally horizontal path of movement and stopping said advance after said fabric has moved a predetermined distance to present said fabric at an operating station for processing;

b. means located at said operating station for cutting said fabric into two pieces along a line transverse to said path of movement thereof;

c. means located at said operating station for folding the end portion of each of said cut fabric pieces along a first transverse fold line to overlap a first adjacent portion of said fabric piece and for folding said first adjacent portion along a second transverse fold line to overlap a next adjacent portion of said fabric piece with said end portion disposed between said first and next adjacent portions so as not to expose the cut edge of said end portion, and d. means located at said operating station for securing said folded end portion of each said fabric piece to its next adjacent portion along a transverse line located near the cut edge of said end portion, said securing means including a supply of adhesive filaments, carrier means arranged to selectively carry said filaments transversely across said fabric to positions corresponding with said transverse securing lines of said fabric pieces, and means for melting said adhesive filaments.

19. Apparatus for forming hemmed curtains and the like as defined in claim 18 and further characterized in that said carrier means adhesive filaments transversely across said fabric simultaneously with the advance of said fabric along said horizontal path of movement and prior to the folding of said fabric pieces by said folding means.

20. Apparatus for forming hemmed curtains and the like as defined in claim 19 and further characterized in that said securing means includes hold-down means for engaging said filaments after they have been carried across said fabric and holding them against the next adjacent portions of said fabric pieces at said transverse securing lines thereof, and in that said melting means includes electrodes arranged for selective movement to engage said folded end portions and filaments therebetween along said transverse securing lines, said electrodes being selectively energized to generate sufficient heat to melt said filaments.

21. Apparatus for forming hemmed curtains and the like as defined in claim 18 and further characterized in that said supply of adhesive filaments presents a vertically extending filament end at one side of said fabric, and in that said carrier means includes a clamping member which is biased toward a closed filament-clamping position and which is opened against said bias to receive said vertically extending filament end by cam means arranged to temporarily open said clamping member as it approaches said filament end whereby said clamping member will open to receive said filament end and close to engage said filament end.

22. A method of forming hemmed curtains and the like from a continuous length of fabric, said method including the steps of a. selectively advancing said continuous length of fabric along a generally horizontal path of movement and stopping said advance after said fabric has moved a predetermined distance;

b. carrying at least two adhesive filaments transversely across said fabric in spaced parallel relation to one another;

c. cutting said stopped fabric into two pieces along a line transverse to said path of movement thereof, and intermediate said spaced adhesive filaments;

d. folding the end portion of each said stopped fabric pieces along a first transverse fold line to overlap a first adjacent portion of said fabric piece and then folding said first adjacent portion along a second transverse fold line to overlap a next adjacent portion of said fabric piece with said end portion disposed between said first and next adjacent portions so as not to expose the cut edge of said end portion and with one of said adhesive filaments disposed between said end portion and said next adjacent portion of each said fabric piece; and e. heating said adhesive filaments while said fabric is stopped to melt said adhesive filament and secure said end portions of each fabric piece to said next adjacent portion thereof.

23. A method of forming hemmed curtains and the like as defined in claim 22 and further characterized in that a third adhesive filament is carried across said fabric for disposition directly between said overlapping first and next adjacent portions of one of said fabric pieces, and in that said third adhesive filament is heated to melt the same and secure said overlapping first and next adjacent portions of said one of said fabric pieces to thereby form a curtain rod pocket in said one fabric piece.

24. A method of forming hemmed curtains and the like as defined in claim 22 and further characterized in that said adhesive filaments are carried transversely across said fabric simultaneously with said advance of said fabric and then held against said fabric after said fabric has been stopped.

* * * * *

UNITED STATES PATENT OFFICE
CERTIFICATE OF CORRECTION

Patent No. 3,963,548 Dated June 15, 1976

Inventor(s) Alexander George et al

It is certified that error appears in the above-identified patent and that said Letters Patent are hereby corrected as shown below:

Column 17, line 15, after "means" insert --carries said--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*